US008667988B2

(12) United States Patent
Cadeau et al.

(10) Patent No.: US 8,667,988 B2
(45) Date of Patent: Mar. 11, 2014

(54) ACTUATING MECHANISM OF A GAS VALVE UNIT

(75) Inventors: Christophe Cadeau, Strasbourg (FR); Stéphane Clauss, Stotzheim (FR); Alexander Eisenberg, Detmold (DE); Jörn Naumann, Durbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 89 days.

(21) Appl. No.: 13/384,602

(22) PCT Filed: Jul. 15, 2010

(86) PCT No.: PCT/EP2010/060176

§ 371 (c)(1),
(2), (4) Date: Jan. 18, 2012

(87) PCT Pub. No.: WO2011/009793

PCT Pub. Date: Jan. 27, 2011

(65) Prior Publication Data

US 2012/0132836 A1 May 31, 2012

(30) Foreign Application Priority Data

Jul. 24, 2009 (EP) ..... 09290590
Mar. 8, 2010 (EP) ..... 10290113

(51) Int. Cl.
*F16K 31/08* (2006.01)

(52) U.S. Cl.
USPC ..... 137/636; 137/627.5; 137/636.3; 251/65; 431/280

(58) Field of Classification Search
USPC ..... 137/636, 636.3, 613, 883, 627.5, 628; 251/65; 431/43
See application file for complete search history.

(56) References Cited

U.S. PATENT DOCUMENTS

| | | | | |
|---|---|---|---|---|
| 3,334,655 | A * | 8/1967 | Eppendahl | 251/65 |
| 4,481,389 | A * | 11/1984 | Johnson | 251/65 |
| 5,938,425 | A | 8/1999 | Damrath et al. | |
| 7,513,247 | B2 | 4/2009 | Clauss et al. | |
| 8,020,586 | B2 * | 9/2011 | Delamarche | 251/65 |
| 2006/0057520 | A1 | 3/2006 | Saia et al. | |

FOREIGN PATENT DOCUMENTS

| | | | |
|---|---|---|---|
| CN | 2431445 | Y | 5/2001 |
| DE | 10249938 | A1 | 5/2004 |
| EP | 0318380 | B1 | 9/1992 |

OTHER PUBLICATIONS

International Search Report PCT/EP2010/060176 , mailed Dec. 17, 2010.
Report of Examination CN 201080032957.4 dated Oct. 29, 2013.

* cited by examiner

*Primary Examiner* — Kevin Lee
(74) *Attorney, Agent, or Firm* — James E. Howard; Andre Pallapies

(57) ABSTRACT

A gas valve unit for adjusting a volumetric gas flow supplied to a gas burner of a gas appliance, in particular a gas cooking appliance, includes at least two open/close valves which can be actuated by moving at least one magnetically active body, in particular a permanent magnet, relative to the open/close valves. For actuating an open/close valve, a position of the magnetically active body, which is preferably implemented in the form of a permanent magnet, can be varied relative to the shut-off body of the open/close valve.

24 Claims, 10 Drawing Sheets

ACTUATING MECHANISM OF A GAS VALVE UNIT

BACKGROUND OF THE INVENTION

The invention relates to a gas valve unit for adjusting a volumetric gas flow supplied to a gas burner of a gas appliance, in particular a gas cooking appliance, wherein the gas valve unit has at least two open/close valves.

Gas valve units of the aforesaid type are described, for example, in the publications EP0818655A2 and WO2004063629A1. By means of gas valve units of this type the volumetric gas flow supplied to a gas burner of a gas cooking appliance can be controlled in a plurality of stages. In this case the volumetric gas flow possesses a reproducible magnitude at each stage. The through-flow cross-section of the gas valve unit overall—and hence the magnitude of the volumetric gas flow—is adjusted by opening or closing specific open/close valves of the gas valve unit and thereby releasing or interrupting the gas flow through specific throttle openings.

In the known generic gas valve units the open/close valves are actuated individually by electromagnetic means. Toward that end each of the open/close valves is assigned a separate electromagnet which opens and closes the open/close valve. The electromagnets are energized and deenergized by means of an electronic control unit. Said electronic control unit processes the signals generated by an operator of the gas cooking appliance by means of an electrical control element and controls the electromagnets of the open/close valves accordingly.

BRIEF SUMMARY OF THE INVENTION

The object underlying the present invention is to provide a more simply designed gas valve unit of the type cited in the introduction.

This object is achieved according to the invention in that the open/close valves can be actuated by moving at least one magnetically active body, in particular a permanent magnet, relative to the open/close valves.

In the preferred embodiment variant the magnetically active body is formed by a permanent magnet which is movable relative to the open/close valves. According to another embodiment variant it is also possible to provide as the magnetically active body an inherently non-magnetic body made of ferromagnetic material. Permanent magnets are then provided in the region of the open/close valves, the magnetic attractive force of said magnets then—dependent on the position of the magnetically active body—acting between the magnetically active body and the respective permanent magnet.

The gas valve unit is actuated by varying the orientation or the spatial alignment of a magnetically active body, in particular a permanent magnet, relative to the open/close valve that is to be actuated. In the following the term "permanent magnet" is representative also of other magnetically active bodies. If the movement of the permanent magnet is effected manually by an operator, no electrical components are required for switching the open/close valves. Alternatively the permanent magnet can also be moved by means of an arbitrary actuating element, an electric motor for example. In this case the electric motor is controlled by an electronic control unit. This enables the same gas valve unit to be actuated optionally mechanically by means of the operator or by means of an electrical actuating element. In the manufacture of cooking appliances gas valve units of identical design can be combined both with mechanical user interfaces, for example rotary knobs, and with electrical user interfaces, for example touch sensors.

Each open/close valve has a movable shut-off body which bears against a valve seat when the open/close valve is closed and thereby seals an orifice in the valve seat. When the open/close valve is in the open state, gas flows through the orifice in the valve seat. Said gas flow is interrupted when the shut-off body of the respective open/close valve bears against the valve seat.

Preferably the valve seat is implemented as a substantially flat surface. The flat surface of the valve seat forms the sealing surface with respect to the shut-off body. This means that no mechanical machining steps are required in order to manufacture the valve seat per se if a sheet material is used for producing the valve seat. It is then only necessary to incorporate the orifices into the flat surface. Alternatively the valve seat can be embodied as a molded seal, in which case the shut-off body is then embodied as planar at its sealing surface. The advantage of this variant is that the risk of damaging the sealing edge at the shut-off body is reduced.

Particularly advantageously the valve seats of the at least two open/close valves are formed by a common component. Said common component can be implemented as a valve sealing plate and for each open/close valve possesses an orifice and a valve seat associated with the orifice. According to a beneficial embodiment of the invention each open/close valve has a spring which presses the shut-off body onto the valve seat when the open/close valve is in the closed state. The spring therefore generates the closing force of the open/close valve. It ensures that the open/close valve closes properly irrespective of the installation position of the gas valve unit, e.g. including when a weight force of the shut-off body works against the force of the spring.

In order to open the open/close valve the shut-off body can be lifted off from the valve seat against the force of the spring by means of the force of the permanent magnet. Each open/close valve can therefore be actively opened by means of the permanent magnet. The shut-off body is embodied from a ferromagnetic material is attracted by the permanent magnet in order to open the open/close valve. When the permanent magnet is moved away from the shut-off body, or when the permanent magnet is completely removed from the gas valve unit, each individual open/close valve closes automatically due to the force of the spring which presses the shut-off body onto the valve seat.

It is also possible to implement the shut-off body of the open/close valve as a permanent magnet. It can then be actuated by moving a non-magnetic ferromagnetic body relative to the shut-off body. Alternatively both the shut-off body and the body that is movable relative to the shut-off body can each also be implemented as a permanent magnet. In this case either the attractive force or the repulsive force of the permanent magnets can be used for actuating the open/close valves.

Preferably each shut-off body is formed by a substantially cylindrical plunger. At its end facing toward the valve seat the shut-off body has a ring-shaped sealing edge.

Each shut-off body is guided in a valve body of the gas valve unit so as to be movable in the axial direction. No provision is made for other directions of movement of the shut-off body.

Advantageously the gas valve unit has a plurality of, preferably at least four, open/close valves. The number of open/close valves influences the number of possible switching stages of the gas valve unit.

A particularly favorable arrangement is realized if the shut-off bodies of the individual open/close valves are arranged on a circular path around an axis of the gas valve unit and the shut-off bodies can be moved parallel to said axis. This results in a ring-shaped arrangement in which the orifices in the valve sealing plate are likewise arranged on a circular path. The shut-off bodies move vertically with respect to the plane of the valve sealing plate.

The position of the magnetically active body that is preferably implemented in the form of a permanent magnet can be varied relative to the shut-off body of the open/close valve in order to actuate the open/close valve. The shut-off body is attracted by the permanent magnet when the shut-off body is located directly above the permanent magnet. In all other positions of the permanent magnet the open/close valve is closed by means of the force of the spring acting on the shut-off body.

Particularly advantageously the at least one magnetically active body that is preferably implemented by a permanent magnet and the open/close valves are embodied in such a way that—dependent on the position of the magnetically active body—either no open/close valve or precisely one open/close valve is open or precisely two open/close valves arranged next to each other are open. The size of the permanent magnet is dimensioned and the possible positions of the permanent magnet are configured in such a way that the permanent magnet can open no more than two open/close valves simultaneously. This is the case when the permanent magnet is located substantially between the notional extension of two shut-off bodies. Precisely one open/close valve is open when the permanent magnet is located substantially exactly on the notional extension of one shut-off body. No open/close valve is open when the permanent magnet is located far enough away from each of the shut-off bodies that the magnetic force is insufficient to lift off the shut-off body from the valve seat against the force of the spring.

A particularly beneficial embodiment of the invention provides that the at least one magnetically active body that is preferably formed by a permanent magnet is arranged on a component of the gas valve unit that is rotatable about the axis of the gas valve unit, the axis preferably being formed by a switching shaft of the gas valve unit and the rotatable component being formed for example by a driver. Rotating the rotatable component causes the permanent magnet to be moved on a circular path. The diameter of said circular path essentially corresponds to the diameter of the circular path on which the shut-off bodies are located. This means that when the rotatable component is rotated the permanent magnet is moved across the shut-off bodies.

A particularly simple arrangement provides that the rotatable component can be rotated about the axis by hand by an operator. No electrical or electronic components at all are necessary for this. The gas valve unit is actuated solely by means of the manual force of the operator who moves the permanent magnet relative to the shut-off bodies of the open/close valves.

It is also possible for the rotatable component to be rotatable about the axis by means of an electrical actuating element. An electric motor, for example a stepper motor, is particularly suitable as an electrical actuating element. In this case the actuating element is controlled by an electronic control unit, for example as a function of the signals of an electrical user interface, or as a function of automated functions, for example an automatic power regulating means or an automatic shutoff.

BRIEF DESCRIPTION OF THE DRAWINGS

Further advantages and details of the invention are explained in more detail with reference to the exemplary embodiments illustrated in the schematic figures, in which.

DETAILED DESCRIPTION OF EXEMPLARY EMBODIMENTS OF THE PRESENT INVENTION

Figure 1:
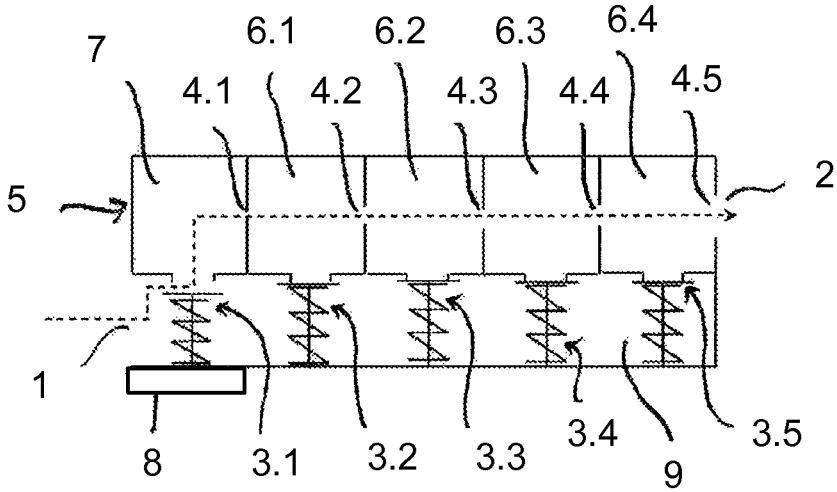
FIG. 1 shows a schematic switching arrangement of the gas valve unit with a first open/close valve open.

FIG. 1 shows the switching arrangement of the gas valve unit according to the invention. The figure depicts a gas inlet 1 by means of which the gas valve unit is connected for example to a main gas line of a gas cooking appliance. The gas provided for burning is present at the gas inlet 1 at a constant pressure of, for example, 20 millibars or 50 millibars. A gas line leading for example to a gas burner of the gas cooking appliance is connected to a gas outlet 2 of the gas valve unit. The gas inlet 1 is connected by way of a gas inlet chamber 9 of the gas valve unit to the inlet side of the five (in the present exemplary embodiment) open/close valves 3 (3.1 to 3.5). Opening the open/close valves 3 causes the gas inlet 1 to be connected in each case to a specific section of a throttle segment 5 into which the gas flows via the opened open/close valve 3. The throttle segment 5 includes an inlet section 7 into which the first open/close valve 3.1 leads. The further open/close valves 3.2 to 3.5 each lead into a respective connecting section 6 (6.1 to 6.4) of the throttle segment 5. The transition between the inlet section 7 and the first connecting section 6.1, like the transitions between two adjacent sections of the connecting sections 6.1 to 6.4, is formed in each case by a throttle point 4 (4.1 to 4.5). The last throttle point 4.5 connects the last connecting section 6.4 to the gas outlet 2. The throttle points 4.1 to 4.5 possess a sequentially increasing opening cross-section. The through-flow cross-section chosen for the last throttle point 4.5 can be so large that the last throttle point 4.5 possesses practically no throttling function.

The open/close valves 3 are actuated by means of a permanent magnet 8 which is movable along the row of open/close valves 3. In this arrangement the force required for opening the respective open/close valve 3 is created directly by the magnetic force of the permanent magnet 8. Said magnetic force opens the respective open/close valve 3 against a spring force.

Only the first open/close valve 3.1 is open in the switching position according to FIG. 1. The gas flows from the gas inlet chamber 9 through said open/close valve 3.1 into the inlet section 7 and from there passes all throttle points 4 and all connecting sections 6 on the way to the gas outlet 2. The volume of gas flowing through the valve unit dictates the minimum performance of the gas burner connected to the gas valve unit.

Figure 2:
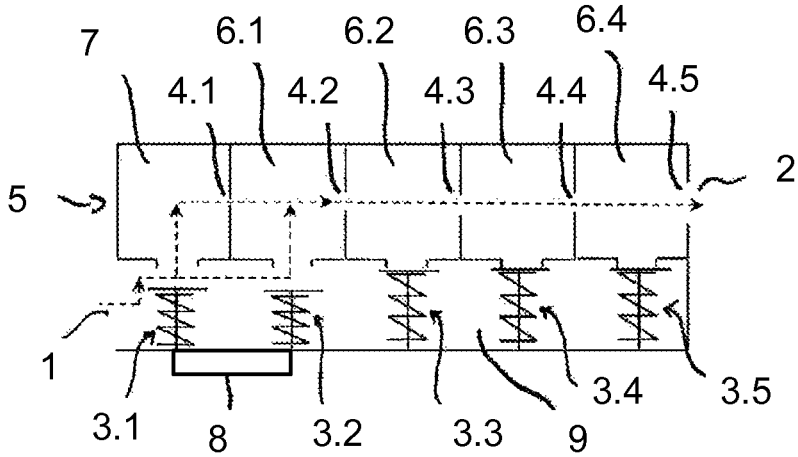
FIG. 2 shows the schematic switching arrangement with two open/close valves open.

FIG. 2 shows the schematic switching arrangement in which the permanent magnet 8 is moved to the right in the drawing such that both the first open/close valve 3.1 and the second open/close valve 3.2 are open.

The gas flows from the gas inlet chamber 9 through the open second open/close valve 3.2 directly into the first connecting section 6.1 and from there via the throttle points 4.2 to 4.5 to the gas outlet 2. Because the open/close valve 3.2 is open the gas flowing to the gas outlet 2 bypasses the first throttle point 4.1. The volumetric gas flow in the switching position according to FIG. 2 is therefore greater than the volumetric gas flow in the switching position according to FIG. 1. The gas inflow into the first connecting section 6.1 takes place practically exclusively via the second open/close valve 3.2. Owing to the open/close valves 3.1 and 3.2 remaining in the open state the same pressure level prevails in the inlet section 7 as in the first connecting section 6.1. For this reason virtually no further gas flows out of the inlet section 7 via the first throttle point 4.1 into the first connecting section 6.1. There is therefore practically no change in the volumetric gas flow flowing overall through the gas valve unit when the permanent magnet 8 is moved further to the right in the drawing and as a result the first open/close valve 3.1 is closed while the second open/close valve 3.2 is open.

By the permanent magnet 8 being moved to the right in the drawing the open/close valves 3.3 to 3.5 are opened in succession and the volumetric gas flow through the gas valve unit is thereby increased step by step.

Figure 3:
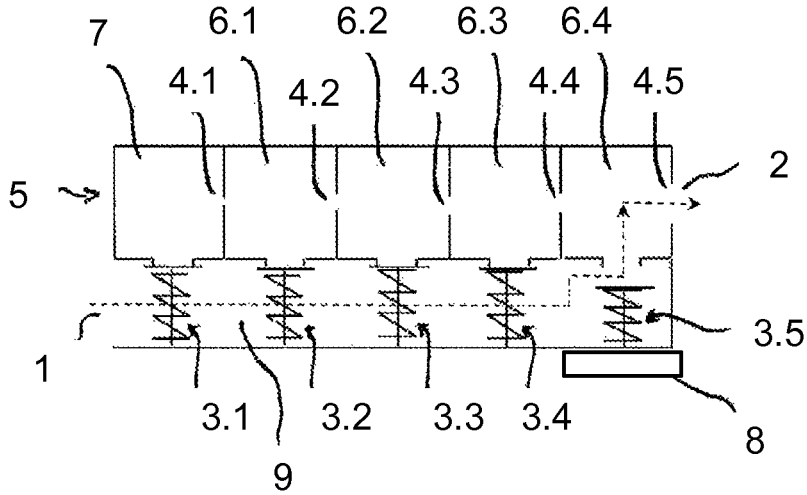
FIG. 3 shows the schematic switching arrangement with the last open/close valve open.

FIG. 3 shows the schematic switching arrangement of the gas valve unit in the maximum open position. In this case the permanent magnet 8 is located at its end position on the right-hand side in the drawing. In this position of the permanent magnet 8 the last open/close valve 3.5 is open. In this case gas flows directly from the gas inlet chamber 9 into the last connecting section 6.4 and passes only the last throttle point 4.5 on the way to the gas outlet 2. Said last throttle point 4.5 can have a through-flow cross-section that is so great that practically no throttling of the gas flow occurs and the gas can flow practically without restriction through the gas valve unit.

FIGS. 4 to 8 schematically show a constructional layout of a gas valve unit having a switching arrangement according to FIGS. 1 to 3. A valve body 20 can be seen in which the gas inlet 1 of the gas valve unit is embodied. Located in the interior of the valve body 20 is a gas inlet chamber 9 connected to the gas inlet 1. Shut-off bodies 10 of the open/close valves 3 are guided in the valve body 20 in such a way that they can move upward and downward as shown in the drawing. Each shut-off body 10 is pretensioned downward as shown in the drawing by means of a spring 11. Each shut-off body 10 can be moved upward as shown in the drawing against the force of the spring 11 by means of the force of the permanent magnet 8. The springs 11 press the shut-off bodies onto a valve sealing plate 12 so that the shut-off bodies 10 seal the orifices 12*a* present in the valve sealing plate 12 in a gas-tight manner. Arranged below the valve sealing plate 12 is a pressure plate 13 having apertures 13*a* corresponding to the orifices 12*a* in the valve sealing plate 12. The apertures 13*a* in the pressure plate 13 lead into apertures 14*a* in a first gas distribution plate 14. According to the drawing, a throttle plate 15 having a plurality of throttle openings 18 is located below the first gas distribution plate 14. In this arrangement each of the throttle points 4.1 to 4.4 is formed by two throttle openings 18. The two throttle openings 18 belonging to one throttle point 4.1 to 4.4 are in each case connected to each other by means of the apertures 16*a* in a second gas distribution plate 16. The apertures 14*a* in the first gas distribution plate, on the other hand, connect the adjacently located throttle openings 18 of two adjacent throttle points 4.1 to 4.5. The last throttle point 4.5 consists of just one throttle opening 18 which leads via a corresponding aperture 16*a* in the second gas distribution plate 16 into the gas outlet 2 of the gas valve unit.

Figure 4:
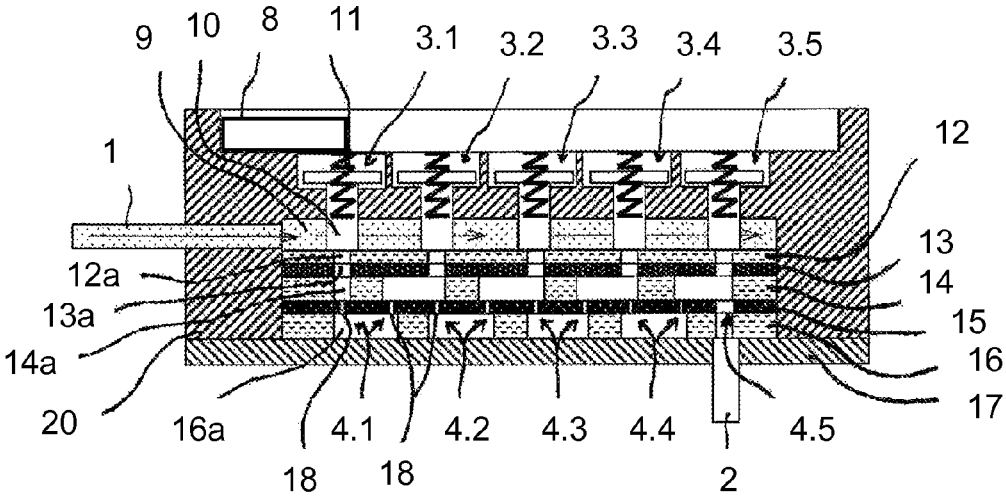
FIG. 4 shows the schematic structure of the gas valve arrangement with open/close valves closed.

In the switching position according to FIG. 4 the permanent magnet 8 is located at an end position in which all of the open/close valves 3 are closed. The gas valve unit as a whole is therefore closed. The volumetric gas flow is equal to zero.

Figure 5:
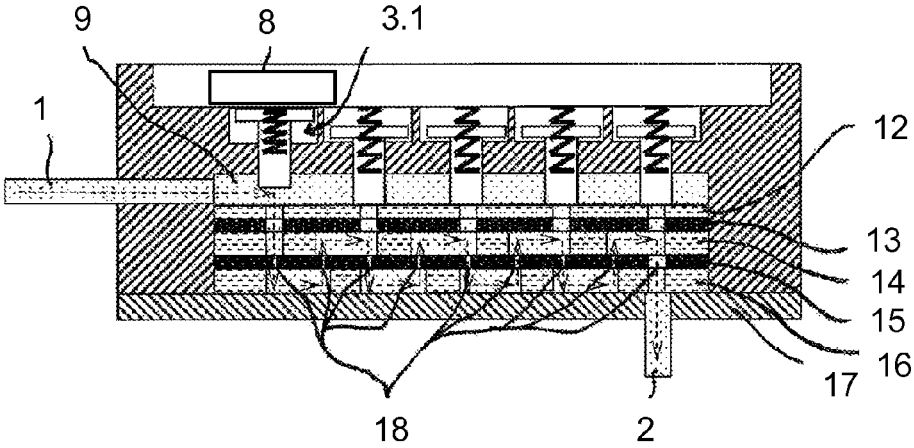
FIG. 5 shows the schematic structure with one open/close valve open.

FIG. 5 shows the schematic structure of the gas valve unit with the first open/close valve 3.1 open. The gas flows from the gas inlet 1 into the gas inlet chamber 9 and from there via the first aperture in each case of the valve sealing plate 12, the pressure plate 13 and the first gas distribution plate 14 to the throttle plate 15. On the way to the gas outlet 2 the gas flows through all the throttle openings 18 of the throttle plate 15 as well as through all the apertures 14*a* of the first gas distribution plate 14 and all the apertures 16*a* of the second gas distribution plate 16.

Figure 6:
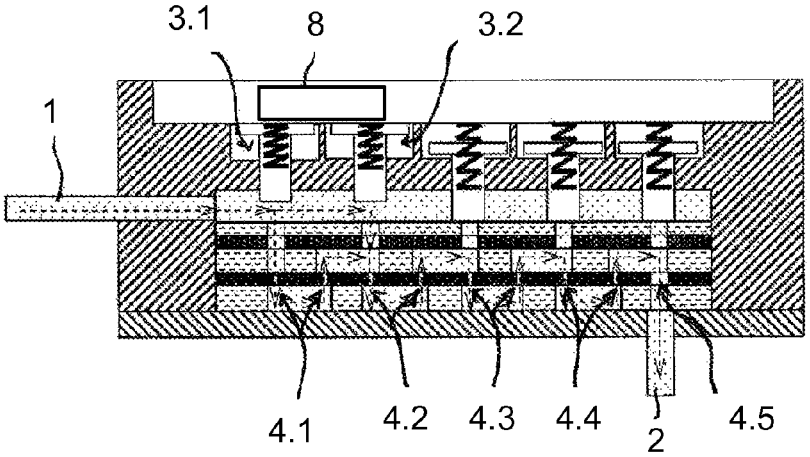
FIG. 6 shows the schematic structure with the first two open/close valves open.

FIG. 6 shows the schematic structure with both first open/close valve 3.1 and second open/close valve 3.2 open. Because the second open/close valve 3.2 is open the throttle openings 18 of the first throttle point 4.1 are bypassed, with the result that the gas goes directly to the second throttle point 4.2 and flows through the further throttle points 4.3 to 4.5 on the way to the gas outlet 2. Because the first open/close valve 3.1 is open the gas path via the first throttle point 4.1 is open. Practically no gas flows through the first throttle point 4.1 owing to the same pressure level prevailing on both sides of the first throttle point 4.1.

Figure 7:
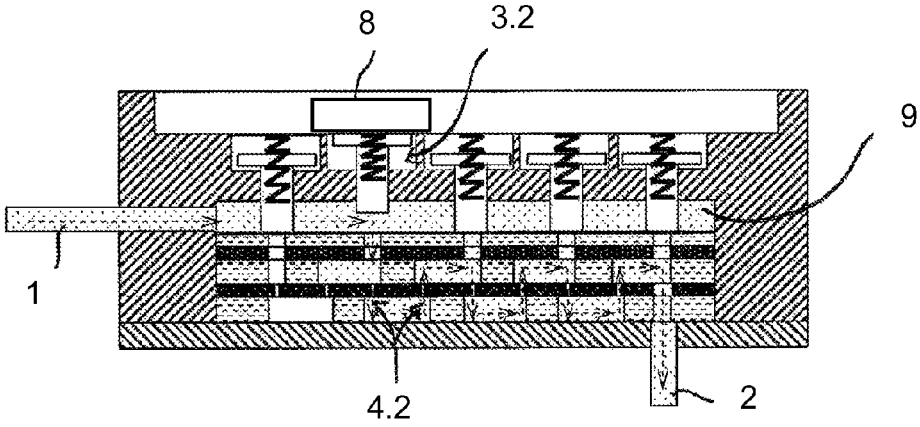
FIG. 7 shows the schematic structure with the open/close valve open.

FIG. 7 shows the schematic structure with the second open/close valve 3.2 open. All the other open/close valves 3.1 and 3.3 to 3.5 are closed. The volumetric gas flow through the gas valve unit is practically identical to the volumetric gas flow in the valve position according to FIG. 6.

The permanent magnet 8 and the components of the open/close valves 3 are coordinated with one another in such a way that when the gas valve unit is open either precisely one open/close valve 3 is open or precisely two open/close valves 3 are open. During the switchover from one open/close valve 3 to an adjacent open/close valve 3, both adjacent open/close valves 3 are always open together briefly. This ensures that a switchover does not lead to a temporary interruption of the gas supply to a gas burner and consequently to flickering or extinction of the gas flames. By means of the above-described switch it is also ensured that no momentary increase in the volumetric gas flow occurs during a switchover operation. Flaring up of the gas flames during a switchover operation is also reliably prevented in this way.

Figure 8:
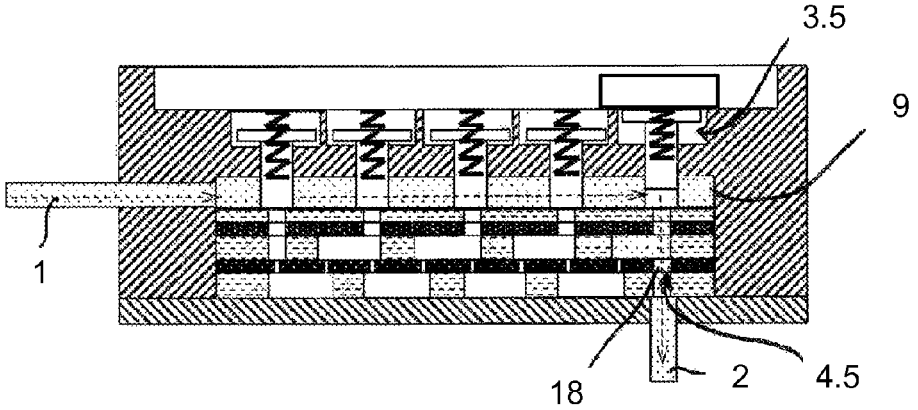
FIG. 8 shows the schematic structure with the last open/close valve open.

FIG. 8, finally, shows the schematic structure of the gas valve unit when only the last open/close valve 3.5 is open. In this case the gas flows from the gas inlet via the gas inlet chamber, the opened open/close valve 3.5 and the last throttle opening 18 associated therewith practically without obstruction to the gas outlet.

Figure 9:
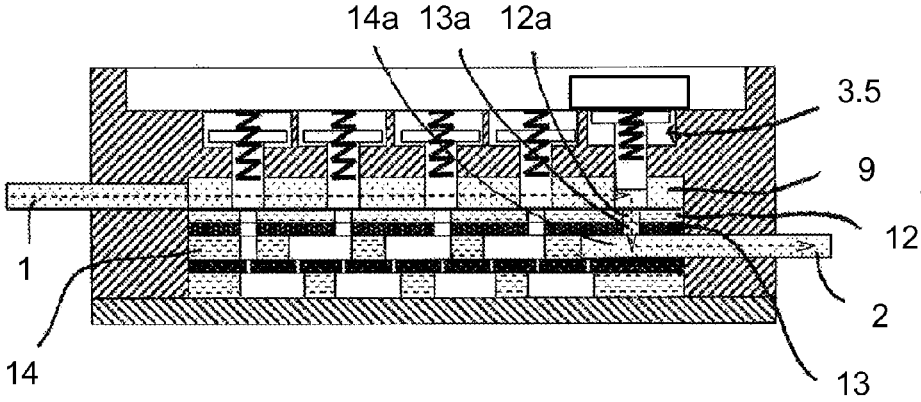
FIG. 9 shows the schematic structure of a variant of the gas valve unit.

FIG. 9 shows the schematic structure of a variant of the gas valve unit. In contrast to the embodiment according to FIGS. 4 to 8, in this case the gas outlet 2 branches off directly from the first gas distribution plate 14. With open/close valve 3.5 open, the gas flows unthrottled via the gas inlet 1, the gas inlet chamber 9, the open/close valve 3.5, the last orifice 12*a* in the valve sealing plate 12, the last aperture 13*a* in the pressure plate 13 and the last aperture 14*a* in the first gas distribution plate 14 to the gas outlet 2. The last throttle point 4.5 (see FIGS. 4 to 8) is not present in the variant according to FIG. 9.

Figure 10:
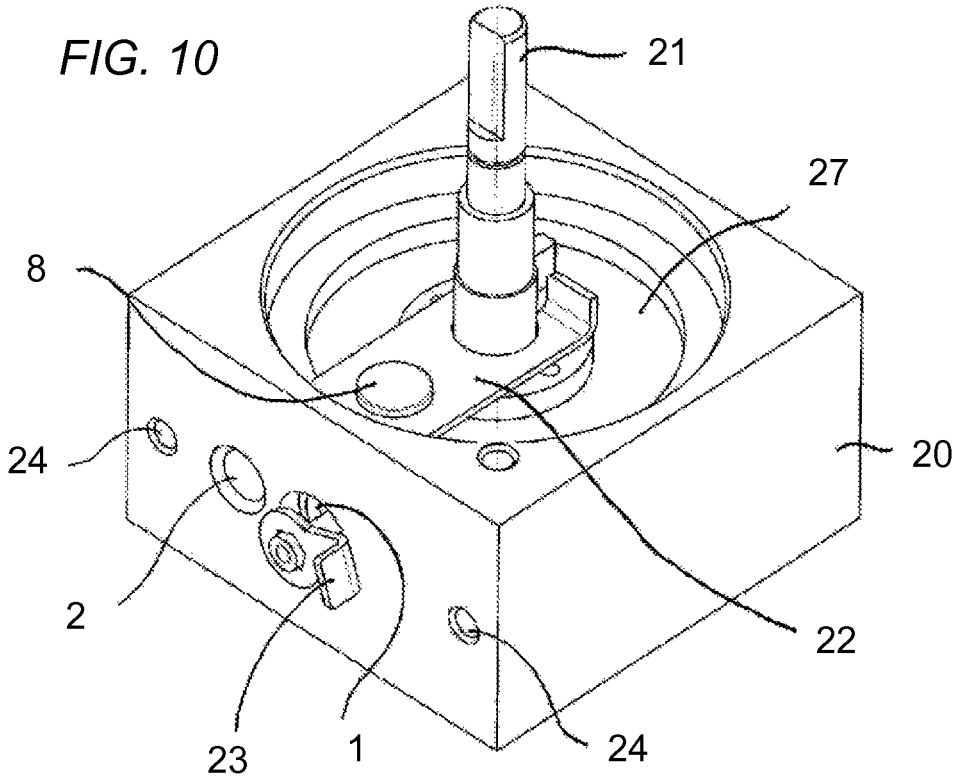
FIG. 10 shows the gas valve unit in a perspective view obliquely from above.

FIG. 10 shows an exemplary embodiment of the gas valve unit in a perspective view obliquely from above. Clearly to be seen in the figure is a valve body 20 in which a switching shaft 21 of the gas valve unit is rotatably mounted. Coupled to the switching shaft 21 is a driver 22 which transmits a rotary movement of the switching shaft 21 to a permanent magnet 8 which is thereby guided on a circular path during a rotary movement of the switching shaft 21. A cover 27 forms a sliding surface for the permanent magnet 8 and establishes a defined clearance between the permanent magnet 8 and the open/close valves 3. Also evident is the gas outlet 2 and an actuating lever 23 arranged in the gas inlet 1 for a solenoid valve unit (not shown). The actuating lever 23 is coupled to the switching shaft in such a way that when the switching shaft is subjected to axial pressure the actuating lever 23 travels out of the valve body 20. Accordingly, the solenoid valve unit can be opened by pressing the switching shaft 21. Boreholes 24 serve for securing the solenoid valve unit to the valve body.

Figure 11:
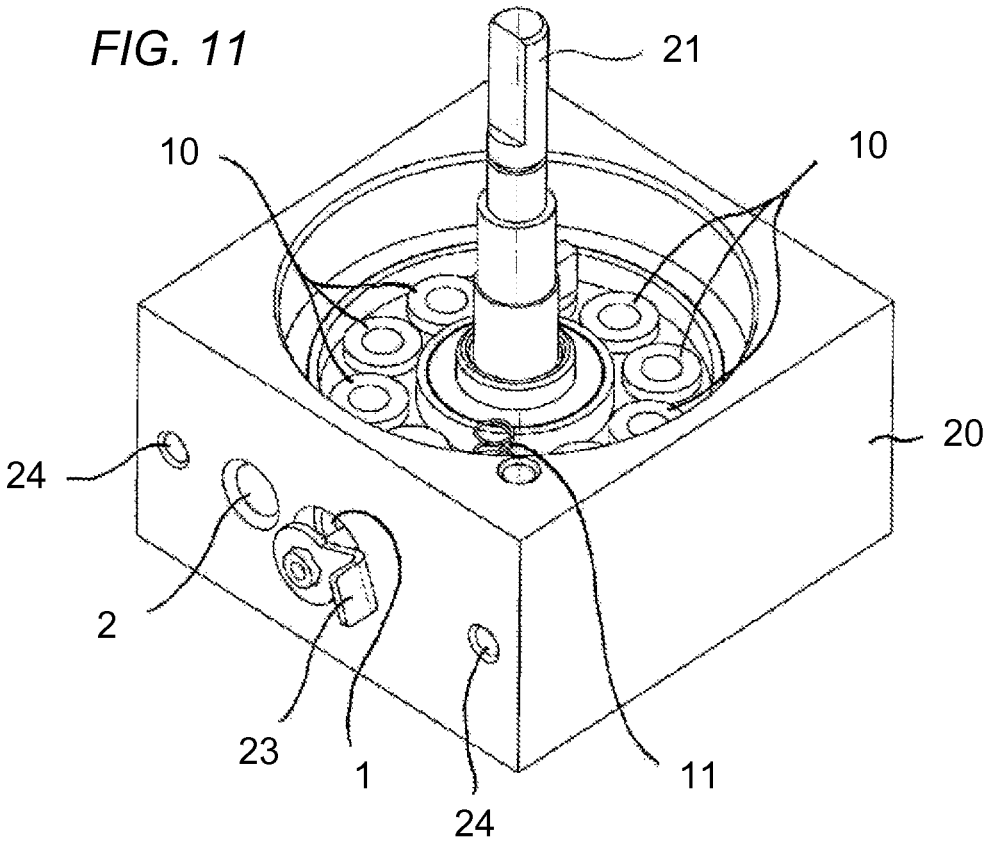
FIG. 11 shows the perspective view looking onto the open/close valves.

FIG. 11 shows the view according to FIG. 10 with the driver 22 and the permanent magnet 8 omitted. Clearly to be seen in FIG. 11 are in particular the annularly arranged shut-off bodies 10 of the open/close valves 3. Each of the shut-off bodies 10 is assigned a spring 11 which presses the shut-off body 10 downward in the drawing. One of the springs 11 is shown in FIG. 11 by way of example.

Figure 12:
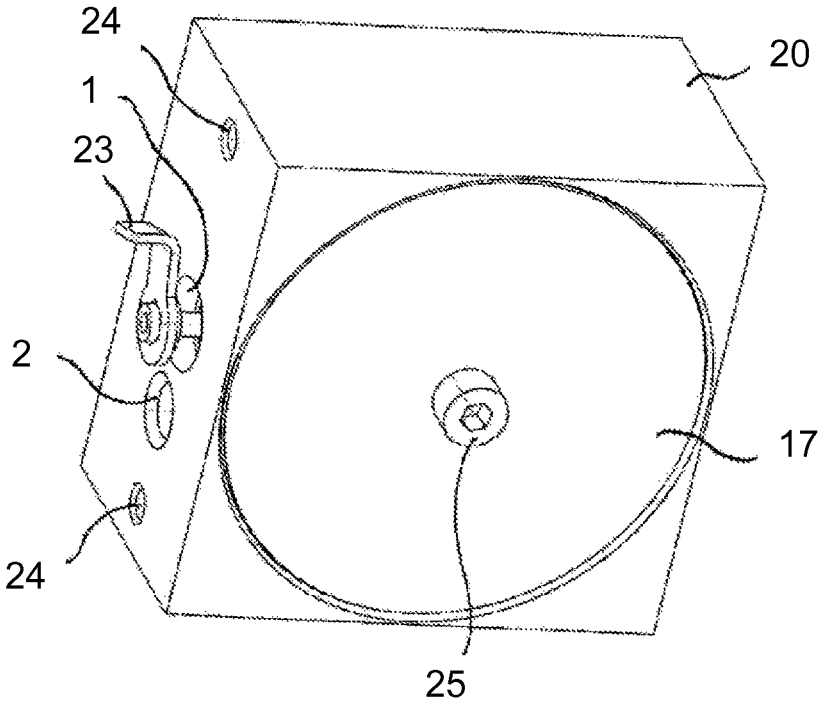
FIG. 12 shows the gas valve unit in a perspective view obliquely from below.

FIG. 12 shows the gas valve unit in a perspective view obliquely from below. Evident here in particular is a closing plate 17 which presses together the remaining plates not shown in the figure, the valve sealing plate 12, the pressure plate 13, the first gas distribution plate 14, the throttle plate 15 and the second gas distribution plate 16. The force required for this is generated by means of a bolt 25.

Figure 13:
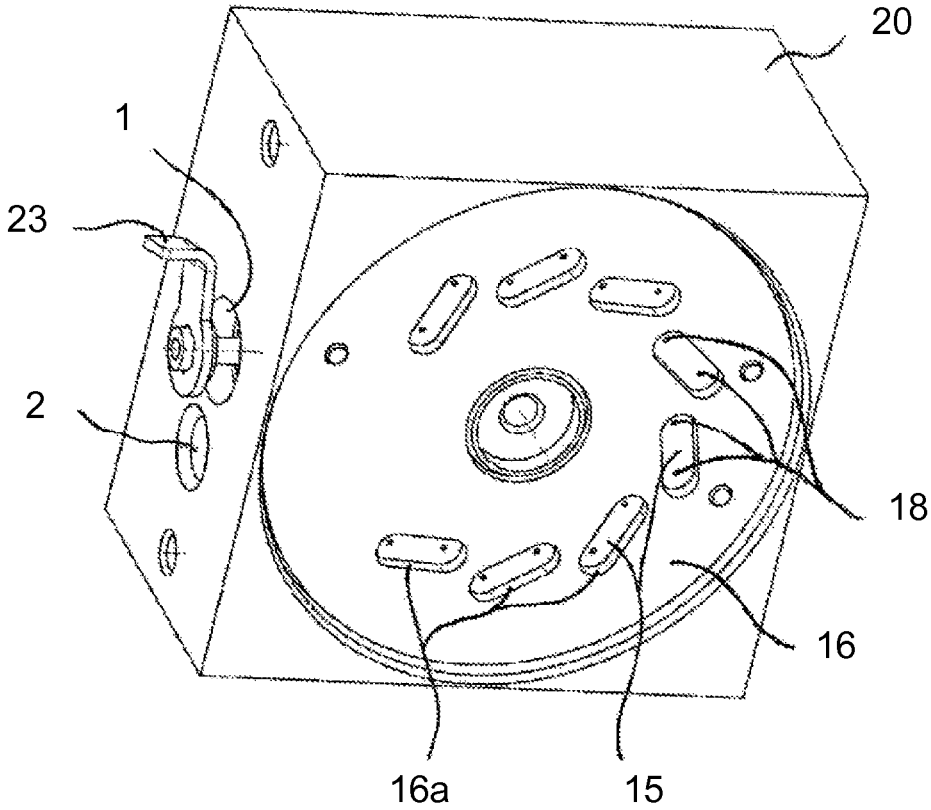
FIG. 13 shows the perspective view looking onto a lower gas distribution plate.

FIG. 13 shows the view according to FIG. 12 with closing plate 17 removed. Evident here is the second gas distribution plate 16 having the apertures 16*a*. Sections of the throttle plate 15 with the throttle openings 18 contained therein can be seen through said apertures 16*a*. It can also be seen that two throttle openings 18 in each case are connected via an aperture 16*a* of the second gas distribution plate 16.

Figure 14:
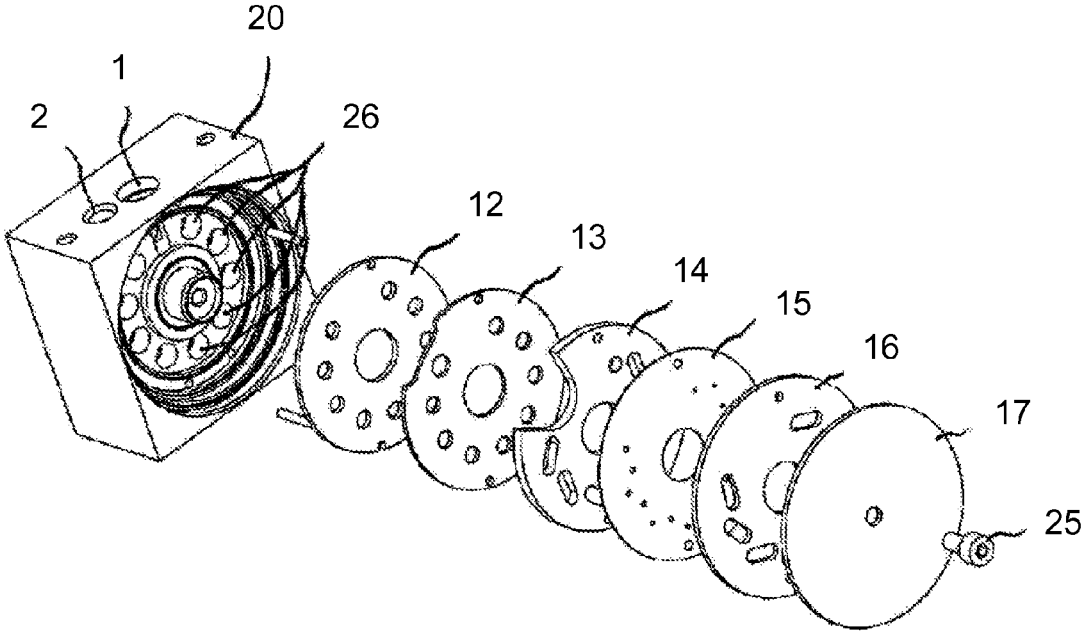
FIG. 14 is an exploded view of the gas valve unit, looking obliquely from below.

The layer-by-layer structure of the gas valve unit is illustrated with the aid of FIG. 14 in an exploded view. Evident here is the valve body 20 with guide boreholes 26 for the shut-off bodies 10 (not shown in the present view) of the open/close valves 3. The below-cited plates are inserted into the valve body 20 in the following order: valve sealing plate 12, pressure plate 13, first gas distribution plate 14, throttle plate 15, second gas distribution plate 16, closing plate 17. The bolt 25 presses the plates 12, 13, 14, 15, 16, 17 supported on the valve body 20 onto one another.

In the present exemplary embodiment the plates 12, 13, 14, 15, 16, 17 are inserted individually into the valve body 20. It is, however, also possible to prefabricate the plates 12, 13, 14, 15, 16, 17 as a package so that they can only be inserted into the valve body 20 and removed again all together. In order to convert the gas valve unit to another type of gas it will then be necessary, depending on the design, to replace either just the throttle plate 15 or the entire package composed of the plates 12, 13, 14, 15, 16, 17.

Figure 15:
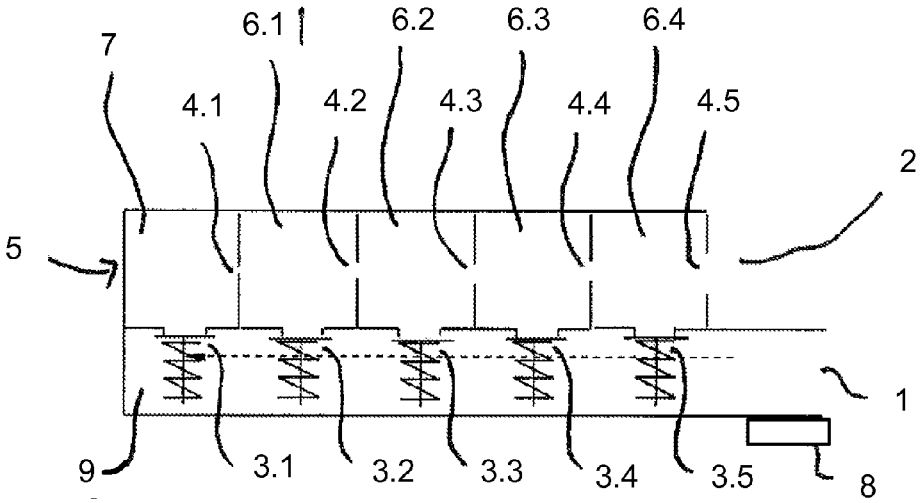
FIG. 15 shows a variant of the switching arrangement according to FIGS. 1-3 in the fully closed state.

FIG. 15 shows a variant of the switching arrangement according to FIGS. 1 to 3. The arrangement of the throttle segment 5 with the throttle points 4 (4.1 to 4.5) corresponds exactly to the arrangement according to FIGS. 1 to 3. The arrangement of the gas inlet chamber 9, as well as of the open/close valves 3 (3.1 to 3.5), also corresponds to the exemplary embodiment according to FIGS. 1 to 3. In contrast to the exemplary embodiment according to FIGS. 1 to 3 the gas inlet 1 is located on the right-hand side of the gas inlet chamber 9 in the drawing. However, the location of the gas inlet 1 in relation to the gas inlet chamber 9 and hence also the flow direction of the gas inside the gas inlet chamber 9 are largely immaterial for the functioning of the gas valve unit. Within the throttle segment 5 the gas flows, analogously to the arrangement according to FIGS. 1 to 3, in the left-to-right direction. Accordingly, the throttle point 4.1 on the left in the drawing is designated as the first throttle point. The throttle point 4.5 on the right in the drawing is designated as the last throttle point. Observing this nomenclature, the open/close valve 3.1 on the left in the drawing will be referred to in the following—as also in the exemplary embodiment according to FIGS. 1 to 3—as the first open/close valve and the open/close valve 3.5 on the right in the drawing as the last open/close valve.

In the switching position shown in FIG. 15 the permanent magnet 8 is located to the right of the last open/close valve 3.5. The permanent magnet 8 therefore exerts a magnetic force on none of the open/close valves 3, which consequently means that none of the open/close valves 3.1 to 3.5 is open. Thus, the gas valve unit is fully closed and the connection between gas inlet 1 and gas outlet 2 is completely blocked.

In order to open the gas valve unit starting from this switching position, the permanent magnet 8 is shifted to the left into the region of the last open/close valve 3.5.

Figure 16:
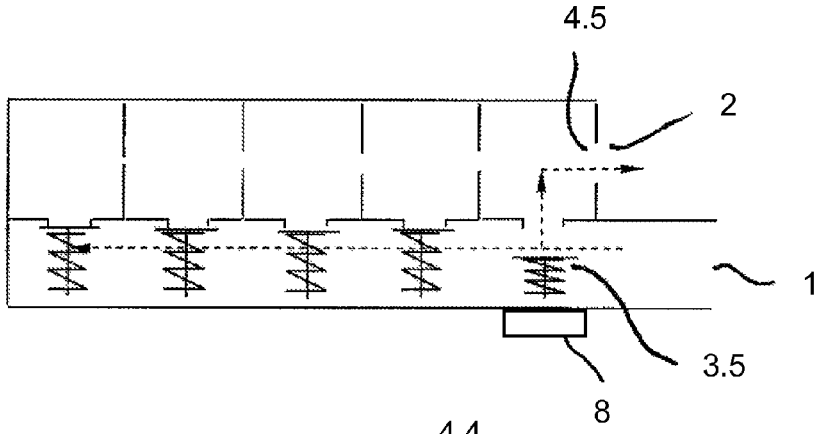
FIG. 16 shows the variant of the switching arrangement in the fully open state with one open/close valve open.

This switching position, in which the gas valve unit is open at a maximum, is shown in FIG. 16. In this case the gas flows from the gas inlet 1 via the opened last open/close valve 3.5 and the last throttle point 4.5 directly to the gas outlet 2. The last throttle point 4.5 can have an opening cross-section that is so great that practically no throttling of the gas flow takes place. In this case the gas flow passes practically unobstructed through the gas valve unit.

Figure 17:
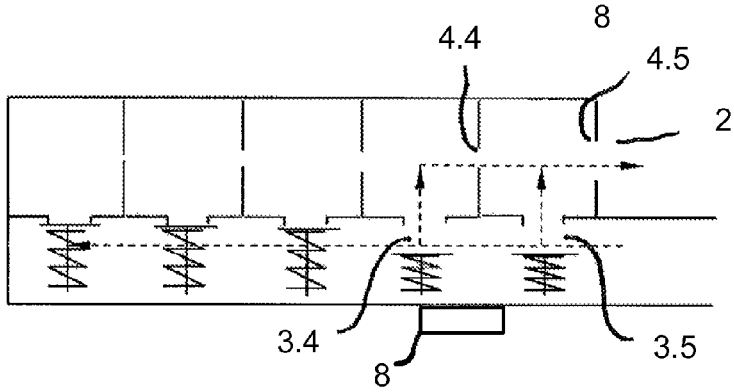
FIG. 17 shows the variant of the switching arrangement in the fully open state with two open/close valves open.

As a result of the permanent magnet 8 being moved to the left in the drawing, the gas flow through the gas valve unit can now be throttled in stages. FIG. 17 shows an intermediate position of the permanent magnet 8 in which the latter opens both open/close valves 3.4 and 3.5. In this case, however, the volumetric gas flow to the gas outlet 2 is practically identical to the volumetric gas flow in the switching position according to FIG. 16.

Figure 18:
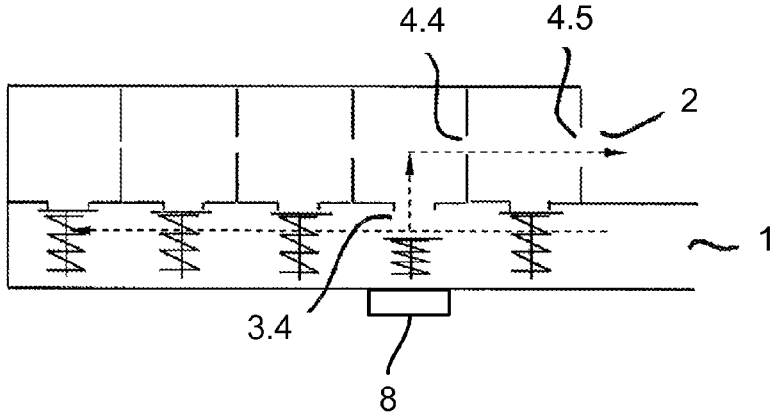
FIG. 18 shows the variant of the switching arrangement in the partially open state.

In the switching position according to FIG. 18 the permanent magnet opens only the open/close valve 3.4. On the way to the gas outlet 2 the gas flow leads both through the throttle point 4.4 and through the throttle point 4.5. The opening cross-section of the throttle point 4.4 is smaller than the opening cross-section of the throttle point 4.5, with the result that the gas flow is somewhat throttled.

Figure 19:
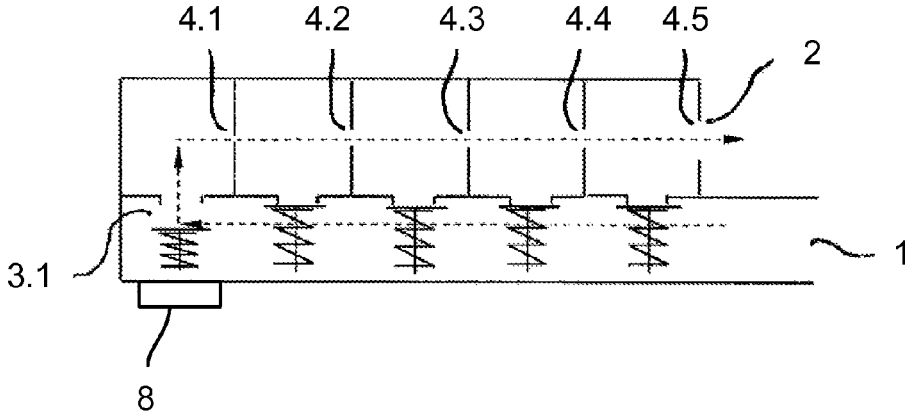
FIG. 19 shows the variant of the switching arrangement in the minimum open state.

FIG. 19 shows the gas valve unit in the minimum opening position, in which only the open/close valve 3.1 is open. On the way to the gas outlet 2 the gas flows through all of the throttle points 4.1 to 4.5. Viewed in the gas flow direction in the throttle segment 5, the throttle points 4 possess an increasing cross-section. Accordingly, the volumetric gas flow becoming established is mainly determined by the throttle point 4.1, which possesses the smallest opening cross-section. The flow resistance caused by the remaining throttle points 4.2 to 4.5 and likewise influencing the volumetric gas flow is taken into account in the dimensioning of the opening cross-sections.

In the switching arrangement according to FIGS. 15 to 19 the gas valve unit is located immediately in its maximum open position when it is actuated starting from its closed position. This has the positive effect that the gas-conducting lines and gas burners disposed downstream of the gas valve unit fill particularly quickly with gas. Furthermore, the gas burner can be ignited immediately after the opening of the gas valve unit at maximum volumetric gas flow, thereby facilitating the ignition process.

LIST OF REFERENCE SIGNS

1 Gas inlet
2 Gas outlet
3 (3.1 to 3.5) Open/close valves
4 (4.1 to 4.5) Throttle points
5 Throttle segment
6 (6.1 to 6.4) Connecting section
7 Inlet section
8 Permanent magnet
9 Gas inlet chamber
10 Shut-off body
11 Spring
12 Valve sealing plate
12*a* Orifices
13 Pressure plate
13*a* Apertures
14 First gas distribution plate
14*a* Apertures
15 Throttle plate
16 Second gas distribution plate
16*a* Apertures
17 Closing plate
18 Throttle openings
20 Valve body
21 Switching shaft
22 Driver
23 Actuating lever
24 Boreholes
25 Bolt
26 Guide boreholes
27 Cover

The invention claimed is:

1. A gas valve unit for adjusting a volumetric gas flow supplied to a gas burner of a gas appliance, said gas valve unit comprising:

at least two open/close valves, and at least one magnetically active body being movable with respect to the at least two open/close valves, wherein each of the at least two open/close valves is actuated by moving the at least one magnetically active body relative to each respective open/close valve of the at least two open/close valves, and wherein the at least one magnetically active body is moveable between:

a first position in which all of the at least two open/close valves are closed;

a second position in which only one of the at least two open/close valves is open; and a third position in which two open/close valves of the at least two open/close valves are open.

2. The gas valve unit of claim 1, wherein the gas valve unit is a gas valve unit of a gas burner of a gas cooking appliance and the at least two open/close valves of the gas valve unit are configured to control the volumetric gas flow supplied to the gas burner of the gas cooking appliance.

3. The gas valve unit of claim 1, wherein the magnetically active body comprises a permanent magnet.

4. The gas valve unit of claim 1, wherein each of the at least two open/close valves has a movable shut-off body which bears against a valve seat when the open/close valve is closed, thereby sealing an orifice in the valve seat.

5. The gas valve unit of claim 4, wherein the valve seat is implemented as a substantially flat surface.

6. The gas valve unit of claim 4, wherein the valve seats of the at least two open/close valves are formed by a common component.

7. The gas valve unit of claim 6, wherein the common component is formed by a valve sealing plate.

8. The gas valve unit of claim 4, wherein the shut-off body is pressed onto the valve seat by a spring when the open/close valve is closed.

9. The gas valve unit of claim 4, wherein the open/close valve is opened by lifting the shut-off body off the valve seat through application of a force from the magnetically active body.

10. The gas valve unit of claims 4, wherein each shut-off body is formed by a substantially cylindrical plunger.

11. The gas valve unit of claims 4, wherein the gas valve unit comprises a valve body, and wherein each shut-off body is guided in the valve body for movement in an axial direction.

12. The gas valve unit of claim 1, wherein the gas valve unit comprises at least four open/close valves.

13. The gas valve unit of claim 4, wherein the shut-off bodies of individual open/close valves are arranged on a circular path around an axis of the gas valve unit and are movable parallel to said axis.

14. The gas valve unit of claim 13, wherein the axis is formed by a switching shaft of the gas valve unit.

15. The gas valve unit of claim 4, wherein the open/close valve is actuated by varying a position of the magnetically active body in relation to the shut-off body.

16. The gas valve unit of claim 13, wherein the at least one magnetically active body is arranged on a rotatable component of the gas valve unit that is rotatable about the axis of the gas valve unit.

17. The gas valve unit of claim 16, wherein the rotatable component is formed by a driver.

18. The gas valve unit of claim 16, wherein the rotatable component can be rotated about the axis by hand by an operator.

19. The gas valve unit of claim 16, further comprising an electrical actuating element for rotating the rotatable component about the axis.

20. The gas valve unit of claim 1, wherein the at least one magnetically active body actuates at least two adjacent open/close valves of the at least two open/close valves.

21. The gas valve unit of claim 1, wherein the at least one magnetically active body is moveable with respect to the at least two open/close valves such that no more than two open/close valves are opened simultaneously.

22. The gas valve unit of claim 1, further comprising a gas output configured to be coupled to the gas burner, wherein the at least one magnetically active body actuates the respective open/close valves of the at least two open/close valves to permit different amounts of volumetric gas flow to the gas burner, wherein each of the different amounts of volumetric gas flow is greater than zero.

23. The gas valve unit of claim 22, wherein the at least one magnetically active body is moveable with respect to the at least two open/close valves to open the at least two open/close valves in succession to provide a step by step increase in the volumetric gas flow to the gas burner.

24. A gas valve unit for adjusting a volumetric gas flow supplied to a gas burner of a gas appliance, the gas valve unit comprising:

a plurality of open/close valves, and a magnetically active body being movable with respect to the plurality of open/close valves, wherein a movement of the magnetically active body relative to each respective open/close valve of the plurality of open/close valves actuates each of the plurality of open/close valves, and wherein the magnetically active body is moveable between:

a first position in which all of the plurality of open/close valves are closed;

a second position in which only one of the plurality of open/close valves is open; and a third position in which two open/close valves of the plurality of open/close valves are open.

* * * * *